US009227804B2

(12) United States Patent
Tamai et al.

(10) Patent No.: US 9,227,804 B2
(45) Date of Patent: Jan. 5, 2016

(54) RECORDING APPARATUS

(71) Applicant: SEIKO EPSON CORPORATION, Tokyo (JP)

(72) Inventors: Kensuke Tamai, Shiojiri (JP); Hidefumi Minemura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/448,924

(22) Filed: Jul. 31, 2014

(65) Prior Publication Data

US 2015/0035217 A1 Feb. 5, 2015

(30) Foreign Application Priority Data

Aug. 2, 2013 (JP) ..... 2013-161084

(51) Int. Cl.
*B65H 5/36* (2006.01)
*B65H 5/06* (2006.01)

(52) U.S. Cl.
CPC ..... *B65H 5/36* (2013.01); *B65H 5/062* (2013.01); *B65H 2402/232* (2013.01); *B65H 2402/31* (2013.01); *B65H 2402/46* (2013.01); *B65H 2404/144* (2013.01); *B65H 2404/1431* (2013.01); *B65H 2404/1521* (2013.01)

(58) Field of Classification Search
CPC .... B65H 5/062; B65H 5/064; B65H 2402/20; B65H 2402/21; B65H 2402/23; B65H 2402/24; B65H 2402/232; B65H 2402/31; B65H 2404/137; B65H 2404/1371; B65H 2404/144; B65H 2406/24
USPC ..... 271/272
See application file for complete search history.

(56) References Cited

U.S. PATENT DOCUMENTS

2003/0011671 A1 1/2003 Sinmmachi

FOREIGN PATENT DOCUMENTS

JP 2003-025664 1/2003

*Primary Examiner* — Patrick Cicchino
(74) *Attorney, Agent, or Firm* — Workman Nydegger

(57) ABSTRACT

A recording apparatus includes: a recording section that performs recording on a recording medium; a driving roller disposed in a transportation path; a plurality of driven rollers driven to rotate by abutting against the driving roller, and biased to the driving roller; and a frame defining positions of the driven rollers. A biasing member that biases driven rollers applies a biasing force including a first direction component that is in the transportation direction to the frame in a state of being mounted thereon. At least a part of the driven rollers are disposed by being deviated in the position thereof in a second direction opposite to the first direction in a state where the biasing member is not mounted thereon.

12 Claims, 9 Drawing Sheets

RECORDING APPARATUS

BACKGROUND

1. Technical Field

The present invention relates to a recording apparatus represented by a facsimile, a printer, or the like.

2. Related Art

In the related art, in an ink jet printer, recording is performed by ejecting ink from a recording head provided in a lower section of a carriage that is configured to be movable in a scanning direction onto a recording medium that is supported on a support surface.

In the ink jet printer, when the recording medium that is in a position facing the recording head is lifted from the support surface supporting the recording medium, deviation in an attachment position of the ink occurs on the recording medium and recording quality is deteriorated. Thus, in a transportation path of the recording medium in the printer, a driving roller and a driven roller for biasing the driving roller are provided on an upstream side or a downstream side of the recording head and the recording medium is biased to the support surface by the biasing force of the driven roller (see JP-A-2003-25664).

In the printer, the transportation roller is provided on the upstream side of the transportation path of the recording head. A plurality of pinch rollers (driven rollers) abut the transportation roller in the scanning direction of the carriage. The pinch rollers (driven rollers) are rotatably mounted on a pinch roller holder. A spring is mounted on the pinch roller holder and the pinch rollers are biased to the transportation roller by the biasing force of the spring.

In the pinch rollers, the biasing force when biasing the transportation roller by receiving the biasing force from the spring creates the resultant downward force in a height direction of the apparatus and a rearward force in a frontward/rearward direction of the apparatus in the printer.

However, in the printer, one end of the spring mounted on the pinch roller holder is mounted on a frame provided in an apparatus body. Generally, in order to suppress an increase in size and weight of the printer, the frame is formed to be lighter and thinner with metal. Therefore, when a reaction force of the biasing force that is generated in the pinch rollers is exerted on the frame, the frame cannot resist the reaction force and deflection (deformation) occurs in the frame.

Specifically, as in the printer, if a thickness of the frame is thin in the frontward/rearward direction of the apparatus, since the reaction force of the biasing force generated in the plurality of pinch rollers in the frame is exerted to the front of the apparatus, the frame is largely deflected to the front of the apparatus. Furthermore, even if the frame has the same thickness, for example, the frame is largely deflected when the length of the frame is long, as in a case where a product corresponds to an A3 size and the like.

As a result, since deviation occurs in an abutting position of the plurality of pinch rollers against the transportation roller which are disposed in the scanning direction of the carriage, a transportation force of the recording medium is reduced, the recording medium is lifted from the support surface, and the recording head and a recording surface of the recording medium are rubbed, and thereby there is a concern that the recording quality is deteriorated. Furthermore, since a difference is generated in the transportation force in a width direction of a sheet of the recording medium, there is a concern that transportation accuracy of the recording medium decreases and skewing or a paper jam occurs in the transportation path.

SUMMARY

An advantage of some aspects of the invention is to provide a recording apparatus in which transportation accuracy and recording quality of a recording medium can be maintained even if deformation occurs in a frame.

According to an aspect of the invention, a recording apparatus includes: a recording section that performs recording on a recording medium; a transportation driving roller that is disposed in a transportation path of the recording medium; a plurality of transportation driven rollers that are driven to rotate by abutting against the transportation driving roller and are disposed along a direction intersecting a transportation direction of the recording medium, and are biased to the transportation driving roller; and a frame that defines positions of the transportation driven rollers in the transportation direction and extends along the direction intersecting the transportation direction. A biasing member that biases the transportation driven rollers applies a biasing force including a first direction component that is in the transportation direction of the recording medium to the frame in a state of being mounted thereon. At least a part of the transportation driven rollers that is disposed between the transportation driven rollers that are positioned in both ends in the direction intersecting the transportation direction is disposed by being deviated in the position thereof in a second direction that is opposite to the first direction with respect to the transportation driven rollers that are positioned in both ends in the direction intersecting the transportation direction in a state where the biasing member is not mounted thereon.

According to the aspect, in the plurality of transportation driven rollers that are disposed along a direction intersecting a transportation direction of the recording medium and are biased to the transportation driving roller, at least a part of the transportation driven rollers that is disposed between the transportation driven rollers that are positioned in both ends in the direction intersecting the transportation direction is disposed by being deviated in the position thereof in the second direction that is opposite to the first direction with respect to the transportation driven rollers that are positioned in both ends in the direction intersecting the transportation direction in a state where the biasing member is not mounted thereon.

In this case, since the biasing force including the first direction component that is the transportation direction of the recording medium is applied to the frame when mounting the biasing member, the frame is deflected on the side of the first direction. As a result, since the position of the transportation driven rollers of which the positions are disposed by being deviated on the side of the second direction is displaced on the side of the first direction, the deviation of the positions in the transportation direction with respect to the transportation driven rollers positioned on the both ends in the intersecting direction is eliminated or reduced. As a result, since the deviation of the positions of the plurality of transportation driven rollers in the transportation direction in the transportation path is eliminated or reduced, it is possible to maintain the transportation accuracy and the recording quality of the recording medium.

In the recording apparatus, the transportation driven roller that is positioned in a center portion in the direction intersecting the transportation direction may be deviated in the second direction with respect to the transportation driven rollers positioned in both ends in the direction intersecting the transportation direction in the state where the biasing member is not mounted thereon.

According to the aspect, for the plurality of transportation driven rollers, the transportation driven roller positioned in the center portion in the direction intersecting the transportation direction is deviated in the second direction with respect to the transportation driven rollers positioned in ends in the direction intersecting the transportation direction in a state where the biasing member is not mounted thereon. In this case, when mounting the biasing member, since the biasing force including the first direction component that is in the transportation direction of the recording medium is applied to the frame, the frame is deflected on the side of the first direction and the positions of the transportation driven rollers of which the positions are disposed by being deviated on the side of the second direction are displaced on the side of the first direction. As a result, the deviation of the position in the transportation direction with respect to the transportation driven rollers positioned in both ends in the intersecting direction is eliminated or reduced. Therefore, since the deviation of the positions of the plurality of transportation driven rollers in the transportation direction in the transportation path is eliminated or reduced, it is possible to maintain the transportation accuracy and the recording quality of the recording medium.

In the recording apparatus, the plurality of transportation driven rollers may have a deviation amount that increases in the second direction from the both ends in the direction in this state, the transportation direction to the center.

According to the aspect, the deviation amount of the plurality of transportation driven rollers from the ends to the center in the second direction increases. Furthermore, when the frame extending along the direction intersecting the transportation direction is deflected, the deflection amount from the both ends of the frame to the center is gradually increased. Therefore, the deflection amount of the frame cancels the deviation amount of the positions of the transportation driven rollers and the deviation of the positions in the transportation direction between the transportation driven rollers positioned in both ends in the intersecting direction and the transportation driven roller disposed therebetween is eliminated or reduced. As a result, it is possible to maintain the transportation accuracy and the recording quality of the recording medium.

In the recording apparatus, a plurality of support members supporting the transportation driven rollers may be held in the frame along the direction intersecting the transportation direction. At least the part of the support members that is disposed between the support members that are positioned in both ends in the direction intersecting the transportation direction may be disposed by being deviated in the position thereof in the second direction with respect to the support members that are positioned in both ends in the direction intersecting the transportation direction in a state where the biasing member is not mounted thereon.

According to the aspect, regarding the position in which the support member is mounted on the frame, at least a part of the mounting positions of the support member disposed between the mounting positions of the support members positioned in both ends in the direction intersecting the transportation direction is disposed by being deviated in the second direction. Therefore, since the support member can be formed in a uniform shape, it is possible to be used as a common member and to reduce the cost.

In the recording apparatus, the plurality of support members may be swingably provided with respect to a plurality of bearings formed in the frame. At least a part of the bearings that is disposed between the bearings that are positioned in both ends in the direction intersecting the transportation direction may be formed by being deviated in the position thereof in the second direction with respect to the bearings that are positioned in both ends in the direction intersecting the transportation direction in a state where the biasing member is not mounted thereon.

According to the aspect, it is possible to easily deviate the positions of the support members in the transportation direction with respect to the frame by forming the position of the bearing to be deviated in the second direction in the plurality of support members. As a result, it is possible to easily deviate the position of the transportation driven rollers with respect to the frame. Therefore, since the positions of the transportation driven rollers are disposed by being deviated with respect to the frame with a simple configuration, it is possible to suppress the cost.

In the recording apparatus, a plurality of frames may be provided.

According to the aspect, it is possible to reduce the biasing force that is received by the frame from the biasing member by separately providing the frame for each support member in addition to the operational effects of the aspects described above. As a result, since the deflection generated in the frame can be reduced, it is possible to reduce the deviation amount of the positions of the transportation driven rollers in the transportation direction. Furthermore, since the biasing force received by the frame is reduced, and the rigidity of the frame does not need to be larger than necessary, it is possible to thin the frame and to reduce the cost while suppressing the size increase of the printer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
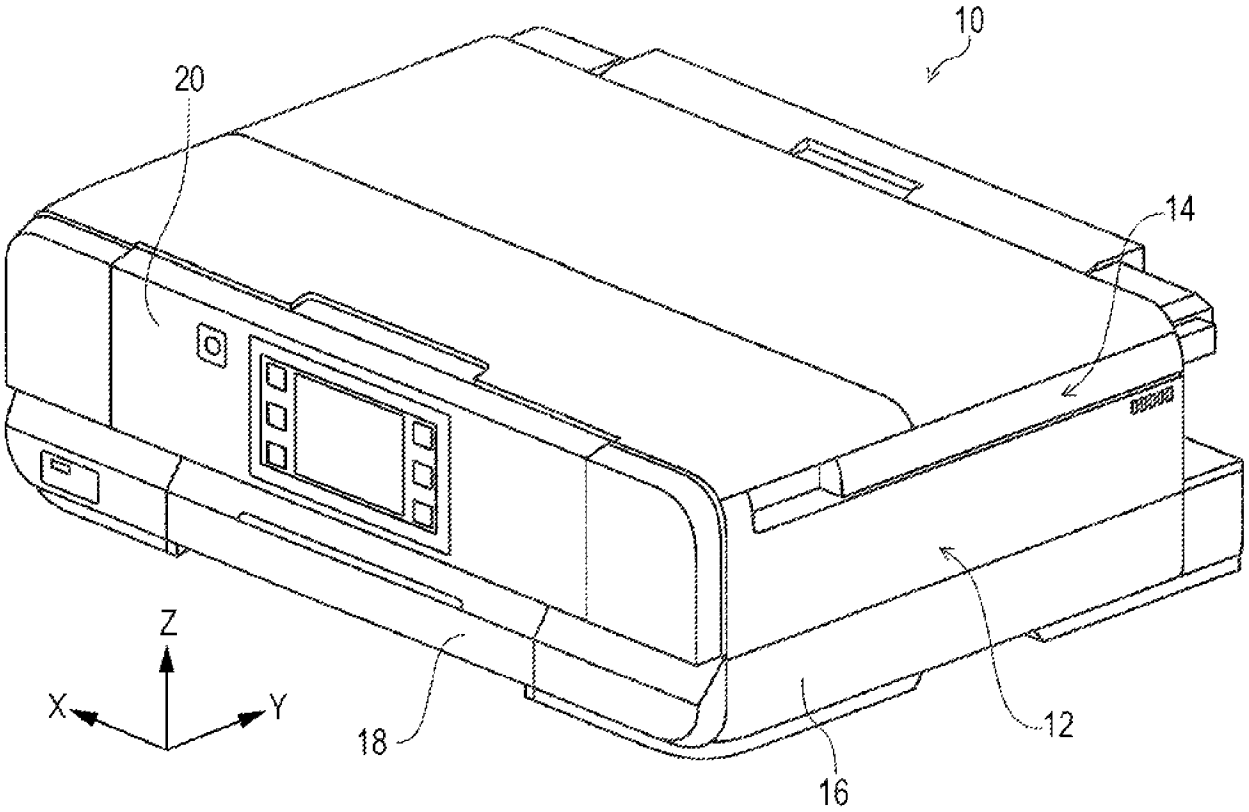
FIG. 1 is a perspective view of a printer according to an embodiment of the invention.

Hereinafter, embodiments of the invention will be described with reference to the drawings. Furthermore, the same reference numerals are given to the same configurations in each embodiment and the description thereof will be described only in the first embodiment and the description of the configurations will be omitted in subsequent embodiments.

Figure 2:
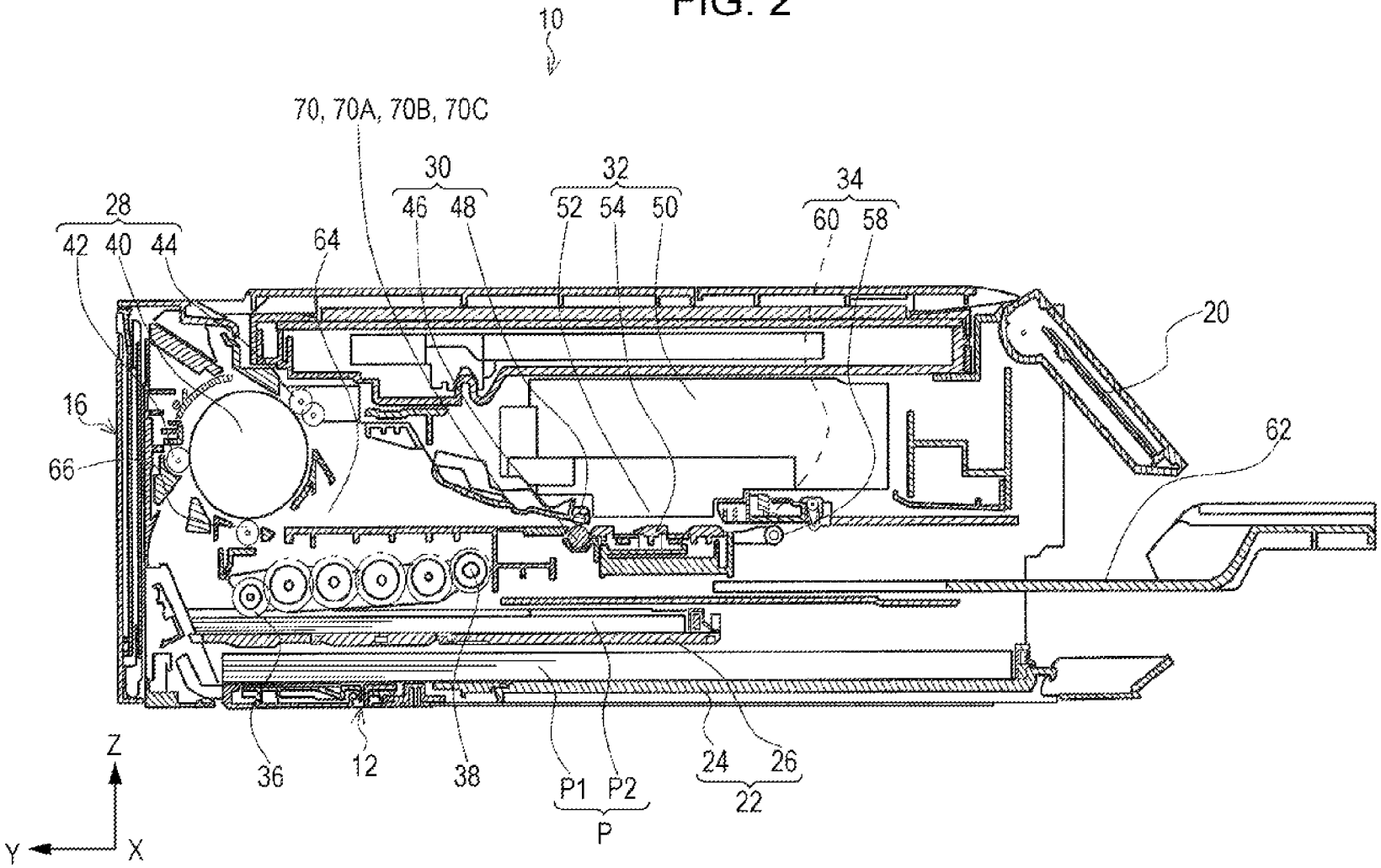
FIG. 2 is a side cross-sectional view illustrating a sheet transportation path of the printer of the embodiment of the invention.
Figure 3:
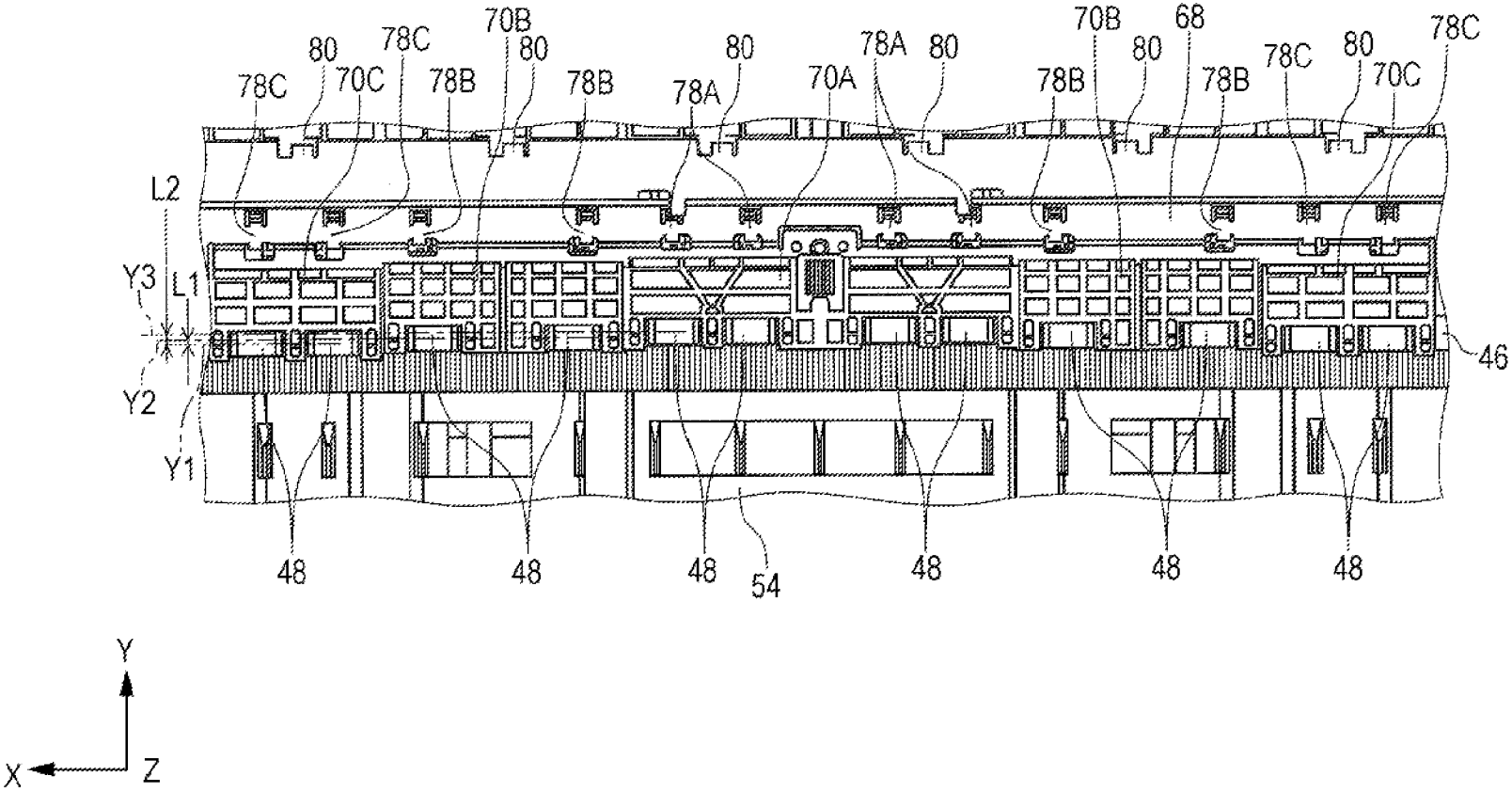
FIG. 3 is a plan view illustrating a state of the transportation driven rollers before a biasing member is mounted thereon in the embodiment of the invention.
Figure 4:
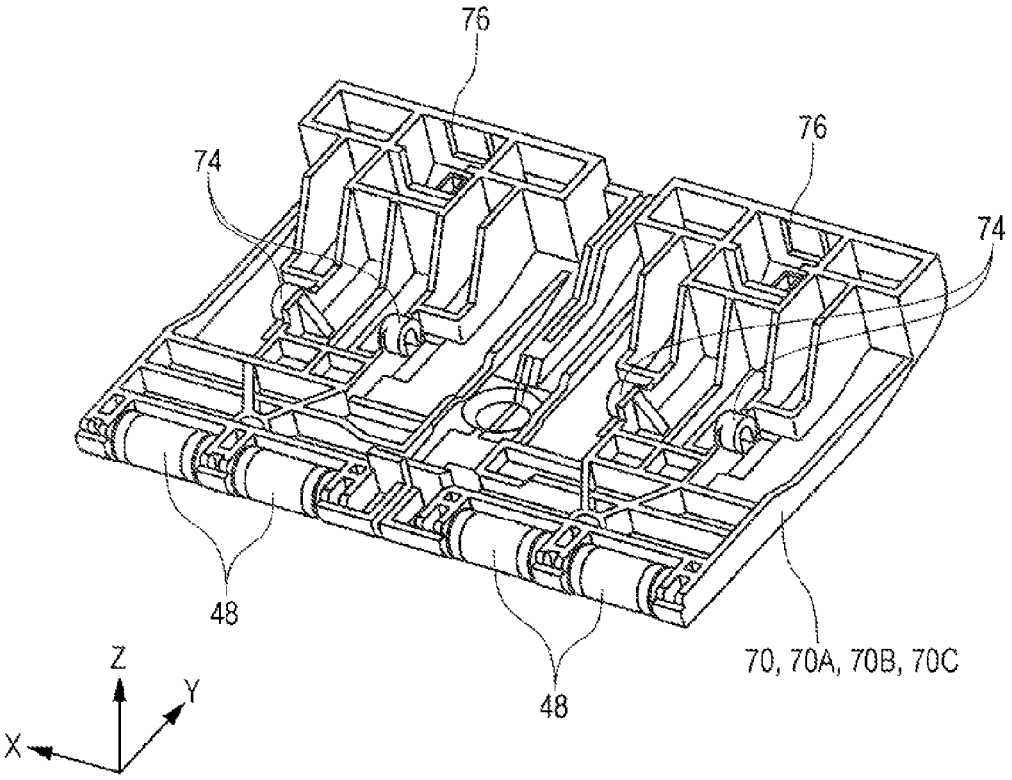
FIG. 4 is a perspective view of support members supporting the transportation driven rollers according to the embodiment of the invention.

FIG. 1 is a perspective view of a printer according to the embodiment of the invention, FIG. 2 is a side cross-sectional view illustrating a sheet transportation path of the printer of the embodiment of the invention, FIG. 3 is a plan view illustrating a state of the transportation driven rollers before a biasing member is mounted thereon in the embodiment of the invention, and FIG. 4 is a perspective view of support members supporting the transportation driven rollers according to the embodiment of the invention.

Figure 5:
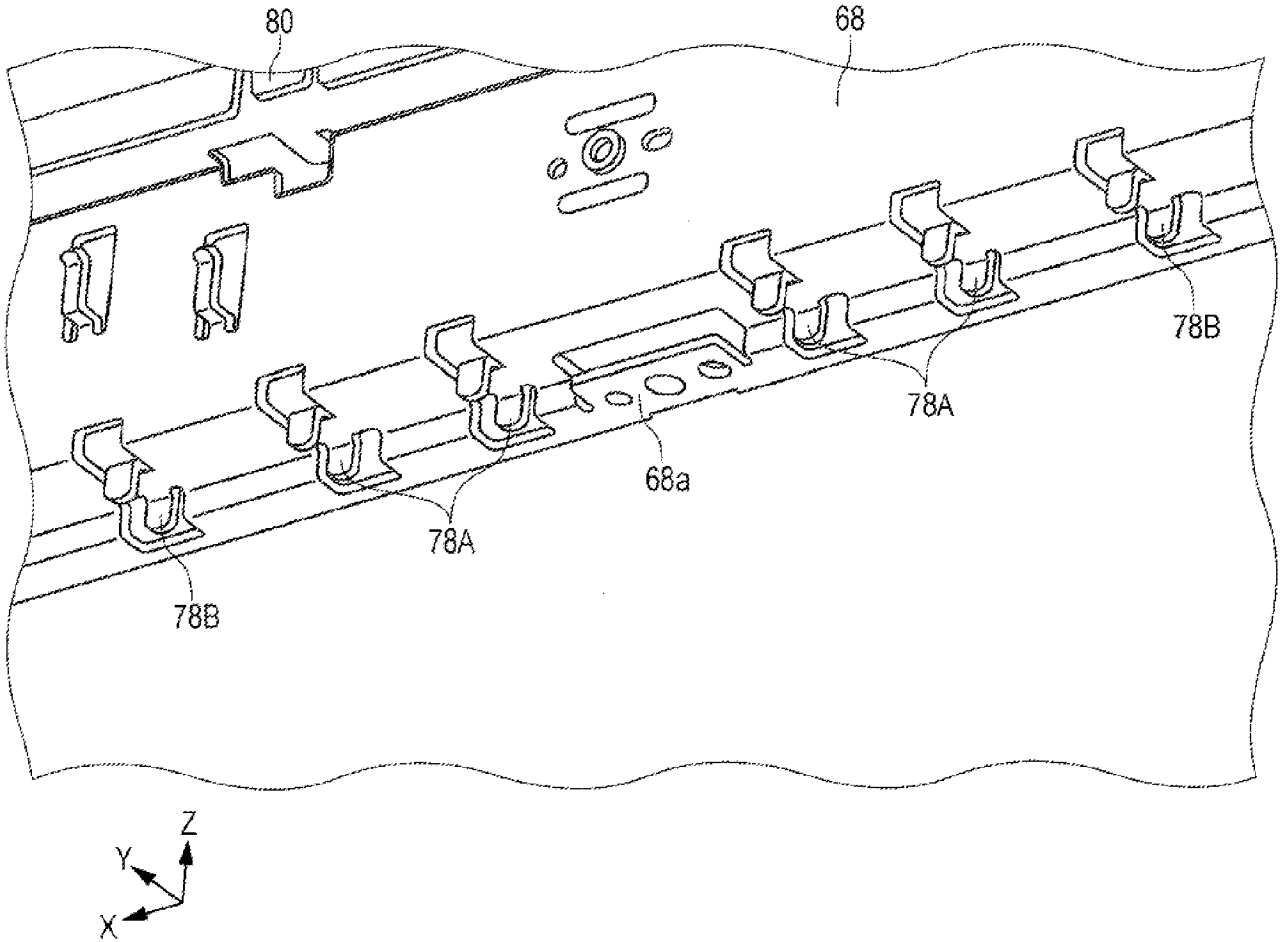
FIG. 5 is a perspective view of a frame on which the support members supporting the transportation driven rollers are mounted thereon according to the embodiment of the invention.
Figure 6:
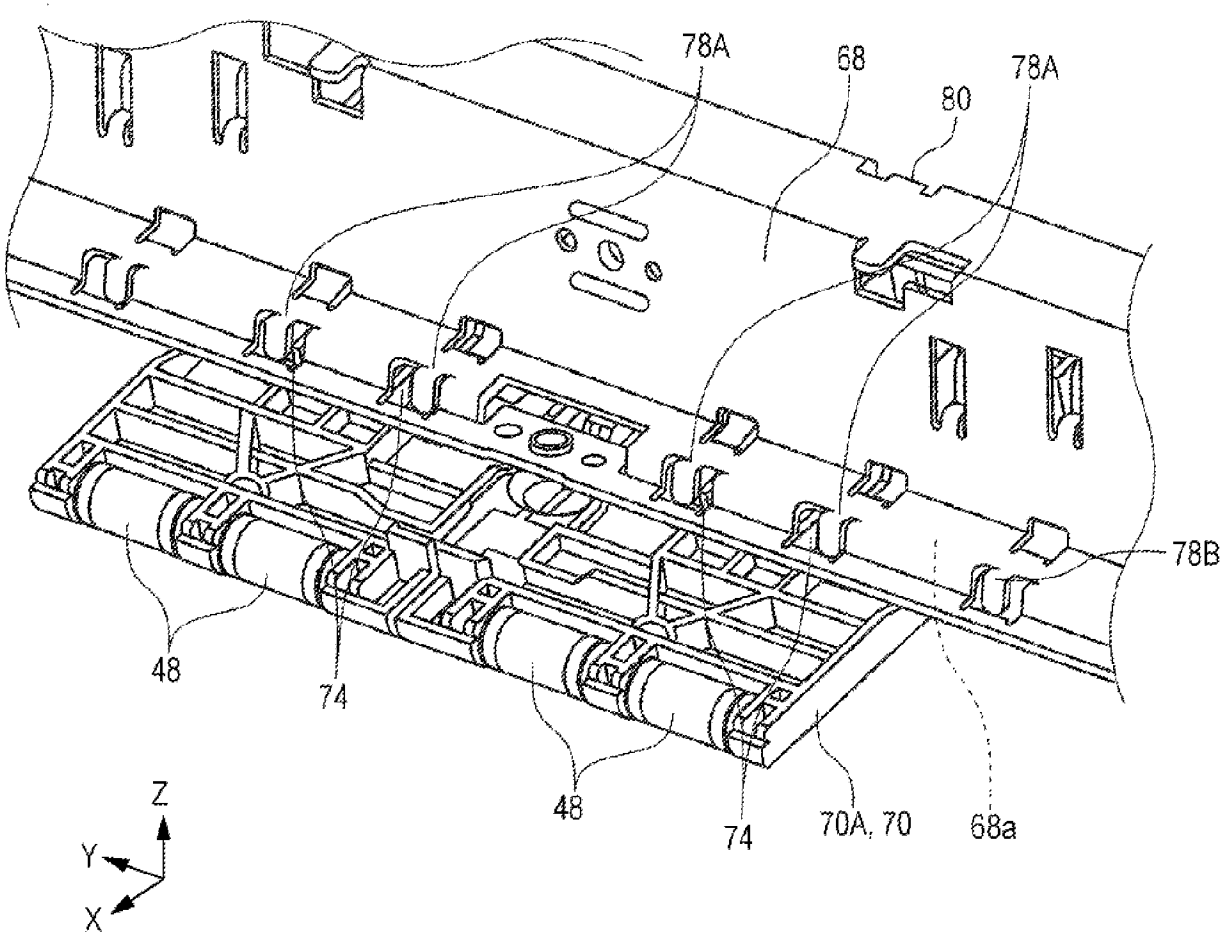
FIG. 6 is a perspective view illustrating a state where the support members supporting the transportation driven rollers are mounted on the frame.
Figure 7:
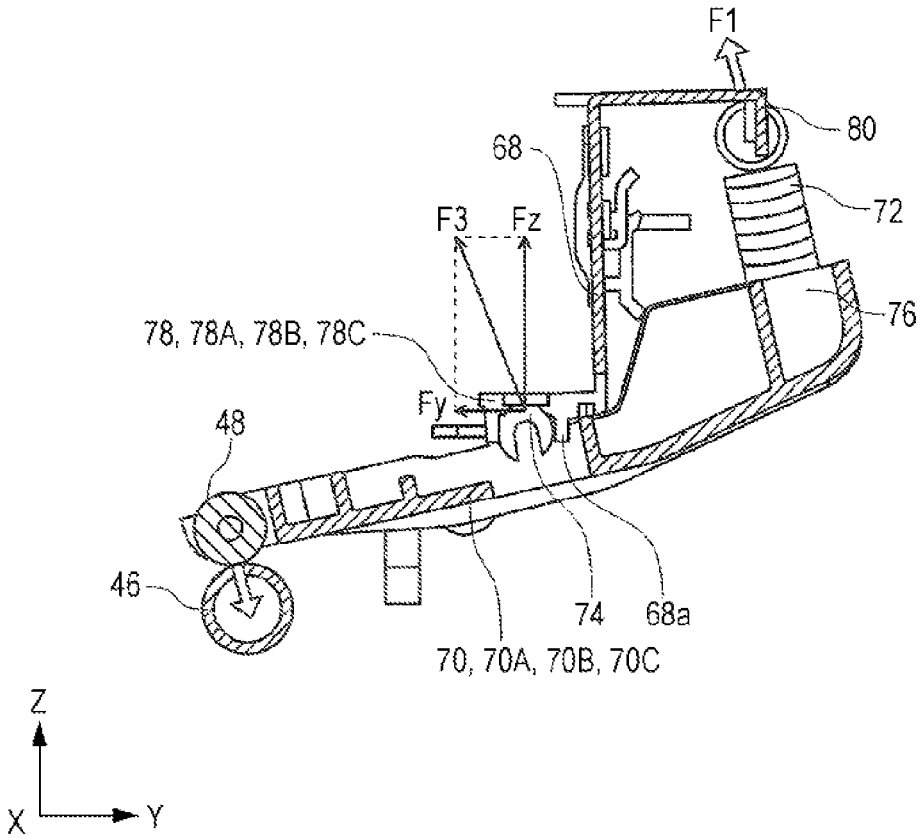
FIG. 7 is a side cross-sectional view illustrating a state where the support members supporting the transportation driven rollers are mounted on the frame.
Figure 8:
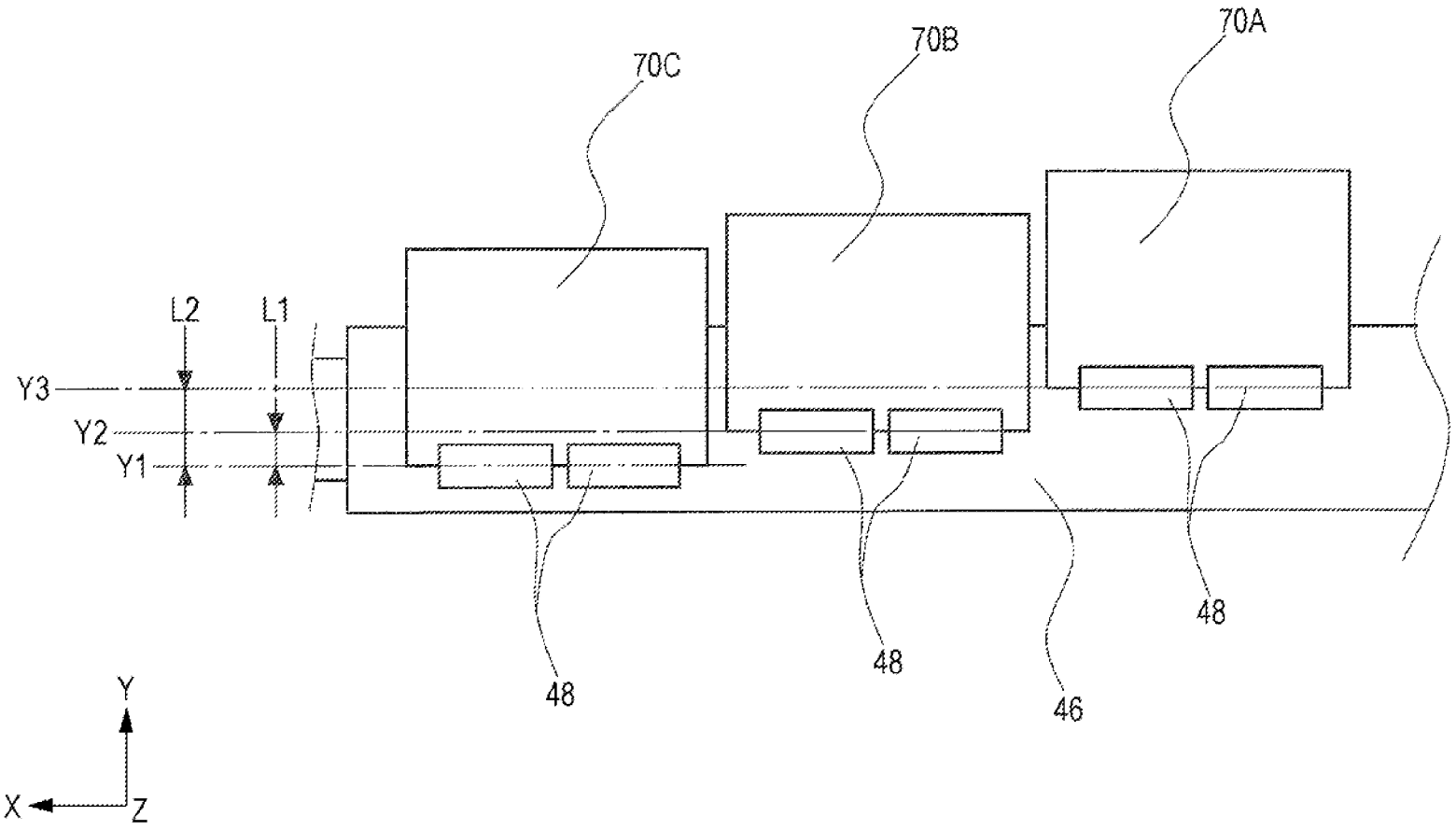
FIG. 8 is an explanatory view illustrating mounting positions of the transportation driven rollers in FIG. 3.
Figure 9:
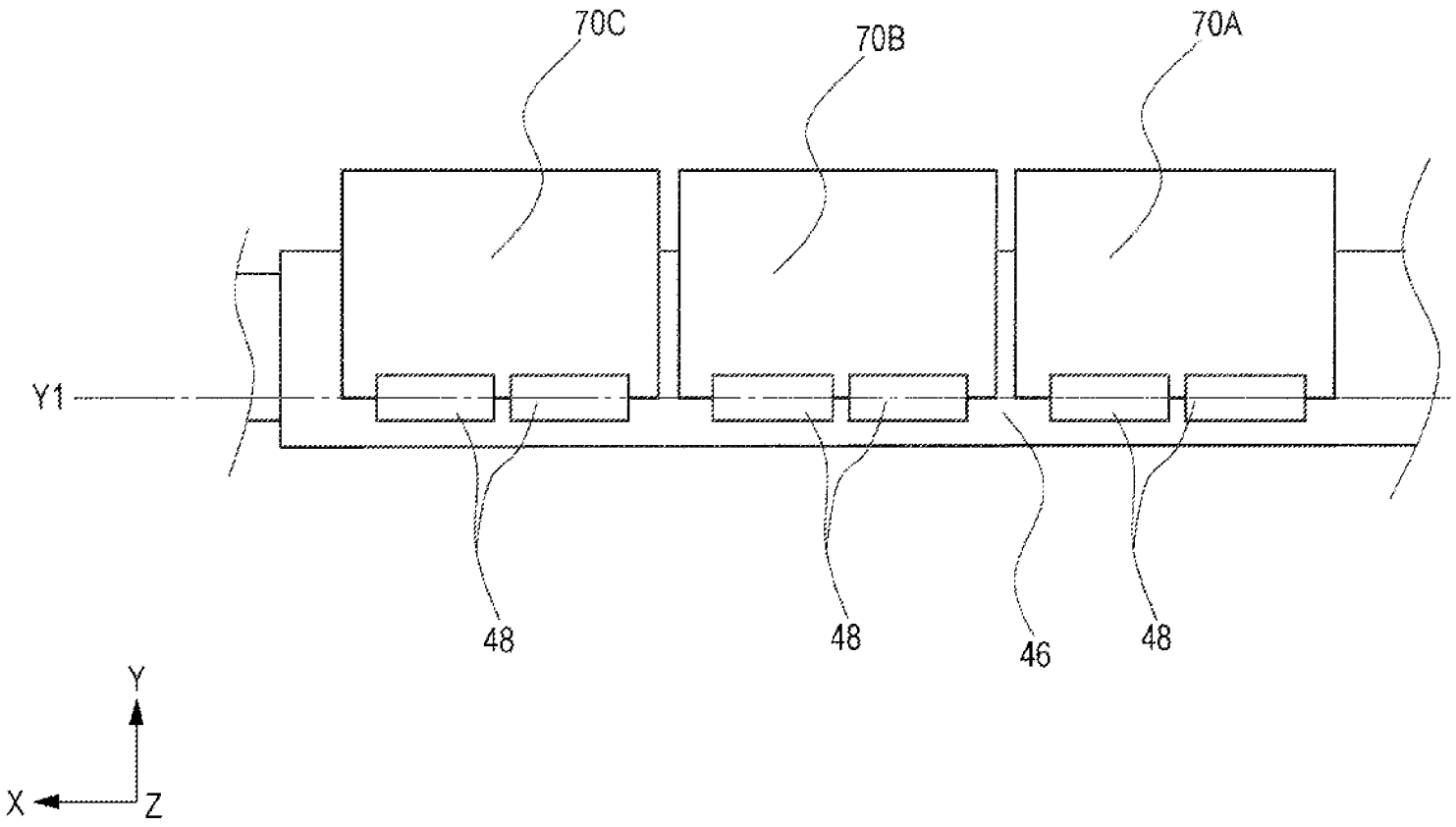
FIG. 9 is a plan view illustrating a state of the transportation driven rollers after the biasing member is mounted thereon in the embodiment of the invention.

FIG. 5 is a perspective view of a frame on which the support members supporting the transportation driven rollers are mounted according to the embodiment of the invention, FIG. 6 is a perspective view illustrating a state where the support members supporting the transportation driven rollers are mounted on the frame, FIG. 7 is a side cross-sectional view illustrating a state where the support members supporting the transportation driven rollers are mounted on the frame, FIG. 8 is an explanatory view illustrating mounting positions of the transportation driven rollers in FIG. 3, and FIG. 9 is a plan view illustrating a state of the transportation driven rollers after the biasing member is mounted thereon in the embodiment of the invention.

Furthermore, in an X-Y-Z coordinate system in each view, an X direction indicates a scanning direction of a recording head, a Y direction indicates a depth direction of a recording apparatus, and a Z direction indicates a direction in which a distance (gap) between the recording head and a medium is changed, that is, is a height direction of the apparatus. Furthermore, in each view, a side of a −Y direction refers to a front side of the apparatus as "a first direction" and a side of a +Y direction refers to a rear side of the apparatus as "a second direction".

Overview of Printer

Configuration elements of an ink jet printer 10 (hereinafter, referred to as "printer 10") as an example of the recording apparatus will be described with reference to FIGS. 1 and 2. The printer 10 includes an apparatus body 12 and an image reading device 14. The apparatus body 12 includes a housing 16 configuring an appearance, a cover 18 that is capable of being open and closed with respect to the housing 16 on the front of the housing, and an operation section 20 provided in a front surface of the housing 16. Even though not illustrated, it is possible to access a medium accommodation section 22 provided inside the housing 16 when the cover 18 is open.

The operation section 20 is configured to include a power supply button or a print setting button for operating the printer 10, a display panel, and the like. Furthermore, the operation section 20 is configured rotatably on the front side of the apparatus with respect to the housing 16 (see FIG. 2).

Next, the configuration element on the sheet transportation path is described in detail with reference to FIG. 2. The apparatus body 12 is configured to include the medium accommodation section 22 having a lower tray 24 that accommodates sheets as a "recording medium" and an upper tray 26 that is positioned above the lower tray 24 and accommodates the sheets, a feeding section 28, a transportation section 30, a recording section 32, a discharge section 34, and a control section (not illustrated). The lower tray 24 and the upper tray 26 are configured to be capable of being mounted on and removed from the front side of the apparatus, respectively with respect to the apparatus body 12, when the cover 18 is open with respect to the front surface of the housing 16.

Furthermore, the upper tray 26 is driven in the depth direction (+Y axis direction in FIG. 2) of the apparatus by a driving mechanism (not illustrated) and is configured to be movable between an abutting position, that is, a feedable position (see FIG. 2) and a retracted position (not illustrated) that is displaced from the abutting position by a predetermined amount in the −Y direction. Furthermore, in FIG. 2, the sheets accumulated in the lower tray 24 are indicated by a symbol P1 and the sheets accumulated in the upper tray 26 are indicated by a symbol P2, respectively (hereinafter, if it is not necessary to specifically distinguish, referred to as "sheet P"). Furthermore, the sheet P is an example of the recording medium.

A pickup roller 36 that is driven to rotate by a driving motor (not illustrated) is provided above each tray. The pickup roller 36 is swingably provided about a swing shaft 38. When the upper tray 26 is in the feedable position, the pickup roller 36 delivers the uppermost sheet P2 from the upper tray 26 to a feeding path by being rotated while coming into contact with the uppermost sheet P2 accumulated in the upper tray 26.

When the upper tray 26 is in the retracted position, the pickup roller 36 delivers the uppermost sheet P1 from the lower tray 24 to the feeding path by being rotated while coming into contact with the uppermost sheet P1 accumulated in the lower tray 24.

Furthermore, the sheet P1 accumulated in the lower tray 24 or the sheet P2 accumulated in the upper tray 26 is fed to the feeding section 28 disposed on the downstream side of the feeding path by the pickup roller 36. The feeding section 28 includes a feed driving roller 40 that is driven by a driving motor (not illustrated), a separation roller 42, and a feed driven roller 44. The separation roller 42 comes into contact with the feed driving roller 40 and performs separation with respect to the sheet P, and feeds only the uppermost sheet P to the downstream side of the feeding path.

Furthermore, the feed driven roller 44 that is driven to rotate by pinching the sheet P between the feed driving roller 40 and the feed driven roller 44 is provided on the downstream side of the separation roller 42. Furthermore, the transportation section 30 including a transportation driving roller 46 that is driven by a driving motor (not illustrated) and a transportation driven roller 48 that is driven to rotate by coming into press contact with the transportation driving roller is provided on the downstream side of the feeding path of the feed driven roller 44. The sheet P is further fed to the downstream side by the transportation section 30.

The recording section 32 is provided on the downstream side of the transportation section 30. The recording section 32 includes a carriage 50, a recording head 52, and a platen 54 that faces the recording head and supports the sheet P. The recording head 52 is provided in a bottom portion of the carriage 50 and faces the sheet P. The carriage 50 is driven to reciprocate in a main scanning direction (a frontward/rearward direction of a surface of the sheet of FIG. 2, that is, an X axis direction) by a driving motor of the carriage (not illustrated).

The platen 54 supports the sheet P and defines a distance between the platen 54 and the recording head 52, that is, a gap PG. The discharge section 34 that feeds the sheet P on which the recording is performed is provided on the downstream side of the platen 54. The discharge section 34 includes a first roller 58 that is driven to rotate by a driving motor (not illustrated) and a second roller 60 that is driven to rotate by coming into contact with the first roller 58.

The sheet P on which the recording is performed by the recording section 32 is pinched between the first roller 58 and the second roller 60, and is discharged to a sheet discharge stacker 62 provided on the front surface side (right side in FIG. 2) of the apparatus body 12. Furthermore, the sheet discharge stacker 62 is configured to be switched to a state of being displaced in a protruding direction to the outside of the apparatus body 12, that is, being drawn out along the Y axis direction with the rotation of the operation section 20 with respect to the apparatus body 12, or a state of being displaced in a direction drawn on the inside of the apparatus body 12.

Furthermore, when performing the recording on both surfaces of the sheet P in the printer 10, after the recording is performed on a first surface of the sheet P by the recording section 32, a side that is a rear end of a sheet when recording is performed on the first surface becomes a front end by an inversion feed operation of the transportation section 30 and the discharge section 34 and then the sheet P is returned on the upstream side of the transportation section 30. Furthermore, the sheet P is fed to an inversion path 64 by a return operation of the transportation section 30. The sheet P fed inside the inversion path 64 is pinched by the feed driving roller 40 and an inversion roller 66, and is returned again to the feeding path.

The sheet P that is returned to the feeding path is fed again to the transportation section 30 of the downstream side of the feeding path by the feed driving roller 40 through the separation roller 42 and the feed driven roller 44. At this time, the first surface and the second surface of the sheet P are curved and inverted, and the second surface faces the recording head 52. The sheet P is fed to the recording section 32 by the transportation section 30. The sheet P on which the recording of the second surface is performed by the recording section 32 is pinched by the discharge section 34 and is discharged to the sheet discharge stacker 62 provided on the front side of the apparatus.

Furthermore, the control section (not illustrated) controls operations that are necessary to execute the recording and the image reading of the printer 10 such as the feeding, the transportation, the discharge, the recording operation, the document reading operation of the medium in the medium accommodation section 22, the feeding section 28, the transportation section 30, the recording section 32, the discharge section 34, and the image reading device 14 depending on an input command from the operation section 20. Furthermore, the operations that are necessary to execute the recording and the image reading of the printer 10 such as the document reading operation may be controlled by instruction from the outside (PC or the like) instead of the input command from the operation section 20.

First Embodiment

A support configuration of the transportation driven rollers according to the first embodiment will be described with reference to FIGS. 3 to 6 and 9. FIG. 3 illustrates a state of the transportation driven rollers 48 abutting the transportation driving roller 46 before a biasing member 72 described below is mounted thereon. The transportation section 30 includes a frame 68 that is formed in the apparatus body 12, transportation driven roller support members 70 (70A, 70B, and 70C) as "support members" that swing with respect to the frame 68 and have the transportation driven rollers 48, and the biasing member 72 (see FIG. 7) as "biasing means", in addition to the transportation driving roller 46 and the transportation driven rollers 48.

In FIG. 3, the frame 68 is formed to extend in the X axis direction in the apparatus body 12. In the frame 68, a plurality of transportation driven roller support members 70A, 70B, and 70C are swingably mounted on the frame 68 along the X axis direction. In the embodiment, the transportation driven roller support members 70C are mounted on both sides of the frame 68 in the X axis direction and the transportation driven roller support member 70A is mounted on a center portion of the frame 68, and the transportation driven roller support member 70B is mounted between the transportation driven roller support member 70A and the transportation driven roller support member 70C.

As illustrated in FIGS. 3 and 8, the transportation driving roller 46 is mounted on the apparatus body 12 and is configured as an elongated roller extending in the X axis direction. Furthermore, an abutting position of the transportation driven rollers 48 mounted on the transportation driven roller support members 70C against the transportation driving roller 46 in the Y axis direction in FIGS. 3 and 8 before the biasing member 72 is mounted is referred to as Y1. Next, an abutting position of the transportation driven rollers 48 mounting the transportation driven roller support members 70B against the transportation driving roller 46 before the biasing member 72 is mounted is in a position deviated by a distance L1 on the side of the +Y direction in the Y axis direction and is referred to as an abutting position Y2.

Furthermore, an abutting position of the transportation driven rollers 48 mounting the transportation driven roller support member 70A against the transportation driving roller 46 before the biasing member 72 is mounted is in a position deviated by a distance L2 on the side of the +Y direction in the Y axis direction and is referred to as an abutting position Y3. That is, the position of each transportation driven roller 48 abutting the transportation driving roller 46 before the biasing member 72 is mounted is configured such that the abutting position is gradually deviated on the side of the +Y direction (upstream side in the transportation direction) from the both ends of the transportation driving roller 46 to the center portion in the X axis direction. Furthermore, in the embodiment, as an example, the distance L1 is set to be 0.05 mm and the distance L2 is set to be 0.1 mm.

Furthermore, the transportation driven roller support member 70 includes a swing shaft 74 and a biasing member mounting section 76 as illustrated in FIG. 4. The transportation driven roller 48 is rotatably mounted on the transportation driven roller support member 70 at the end on the side of the −Y axis direction in FIG. 4. Furthermore, the biasing member mounting section 76 is provided at the end of the transportation driven roller support member 70 on the side of the +Y axis direction in FIG. 4.

Next, the frame 68 extending in the X axis direction in FIG. 5 includes a plurality of swing shaft mounting sections 78 (78A, 78B, and 78C), and a plurality of biasing member holding sections 80 (see FIG. 7) as illustrated in FIG. 5. The swing shaft mounting sections 78 (78A, 78B, and 78C) are provided having appropriate spaces in the X axis direction in a lower surface 68*a* of the frame 68. The plurality of swing shaft mounting sections 78A, 78B, and 78C are formed such that the positions in the Y axis direction are deviated, respectively in the lower surface 68*a* of the frame 68.

Specifically, the swing shaft mounting section 78B on which the transportation driven roller support member 70B is mounted is formed by being deviated with respect to the swing shaft mounting section 78C on which the transportation driven roller support member 70C is mounted by the distance L1 on the side of the +Y direction in the Y axis direction in FIGS. 3 and 5. Furthermore, the swing shaft mounting section 78A on which the transportation driven roller support member 70A is mounted is formed by being deviated with respect to the swing shaft mounting section 78C on which the transportation driven roller support member 70C is mounted by the distance L2 on the side of the +Y direction in the Y axis direction in FIGS. 3 and 5.

That is, in the frame 68, the swing shaft mounting sections 78A, 78B, and 78C are formed such that the transportation driven rollers 48 mounted on the transportation driven roller support members 70A, 70B, and 70C respectively correspond to the positions of the abutting positions Y1, Y2, and Y3 of the transportation driving roller 46 against the transportation driven rollers 48, in the Y axis direction in FIGS. 3 and 5.

Next the mounting of the transportation driven roller support member 70 on the frame 68 will be described with reference to FIGS. 6 and 7. The transportation driven roller support member 70 is disposed below the lower surface 68*a* of the frame 68 and the swing shaft 74 of the transportation driven roller support member 70 is inserted into the swing shaft mounting section 78 of the frame 68. Therefore, the position of the transportation driven roller support member 70 in the Y axis direction in FIGS. 6 and 7 is determined by the swing shaft mounting section 78.

Furthermore, the biasing member holding section 80 is formed on the side of the rear surface of the frame 68. The biasing member holding section 80 is connected to one end of the biasing member 72. Furthermore, the biasing member mounting section 76 provided in the transportation driven roller support member 70 is connected to the other end of the biasing member 72. The biasing member 72 biases the transportation driven roller support member 70 toward the frame 68.

As illustrated in FIG. 7, the transportation driven roller support member 70 is mounted on the frame 68 and if the biasing member 72 biases the transportation driven roller support member 70 toward the frame 68 with a biasing force F1 (see FIG. 7), the transportation driven roller 48 biases the transportation driving roller 46 with a biasing force F2 about the swing shaft 74 in the counter-clockwise direction in FIG. 7. As a result, it is possible to pinch the sheet P between the transportation driving roller 46 and the transportation driven roller 48.

Furthermore, the sheet P is transported on the side of the −Y axis direction (downstream side in the transportation direction) in FIG. 7 by the biasing force F2 in a state where the sheet P is pressed against the transportation driving roller 46 by the transportation driven roller 48. As a result, since the sheet P is transported on the side of the −Y axis direction in a state of being pressed by the platen 54, the space between the recording head 52 and the sheet P is secured.

Furthermore, the swing shaft 74 is pressed against the swing shaft mounting section 78 of the frame 68 by the biasing force F1 of the biasing member 72. Therefore, a pressing force F3 is generated between the swing shaft mounting section 78 and the swing shaft 74.

As illustrated in FIG. 7, the pressing force F3 is a resultant force of a force Fz on the side of the +z axis direction and a force Fy on the side of the −Y axis direction. Therefore, the force Fz that attempts to displace the frame 68 on the side of the +z axis direction in FIG. 7 and the force Fy that attempts to displace the frame 68 on the side of the −Y axis direction in FIG. 7 affect the frame 68.

Here, as illustrated in FIG. 7, since the thickness of the frame 68 on the side of the Y axis direction is thin, the frame 68 is likely to be deformed by receiving the force Fy. Specifically, the frame 68 is deflected toward on the side of the −Y axis direction (downstream side in the transportation direction) across the center portion from both ends of the frame 68 in FIG. 3. Moreover, the width direction of the frame 68 is the Z-axis direction in FIG. 7 and since stiffness thereof is high in the Z-axis direction, the frame 68 is difficult to be deflected even though receiving the force Fz.

If the frame 68 is deflected on the side of the −Y axis direction (downstream side in the transportation direction) across the center portion from the both ends of the frame 68 in the X axis direction, the swing shaft mounting sections 78A and 78B provided in the frame 68 are respectively displaced on the side of the −Y axis direction (downstream side in the transportation direction) depending on a deflection amount within the frame 68.

That is, as illustrated in FIG. 9, the transportation driven rollers 48 mounted on the transportation driven roller support members 70A and 70B are displaced from the abutting positions Y2 and Y3 illustrated in FIG. 8 on the side of the −Y axis direction in FIG. 9. Therefore, the positions Y2 and Y3 of the transportation driven rollers 48 mounted on the transportation driven roller support members 70A and 70B abutting the transportation driving roller 46 are close to the abutting position Y1 of the transportation driven roller 48 mounted on the transportation driven roller support member 70C against the transportation driving roller 46 by attaching the biasing member 72. Therefore, it is possible to eliminate or reduce the deviation between the abutting positions Y2 and Y3, and the abutting position Y1.

Furthermore, it is possible to adjust the size of the force Fy operating on the side of the Y axis direction of the frame 68 by adjusting the biasing force F1 of the biasing member 72. Therefore, the position of the transportation driven rollers 48 abutting the transportation driving roller 46 after the swing shaft mounting sections 78A and 78B are displaced on the side of the −Y axis direction (downstream side in the transportation direction) can be the abutting position Y1 of the transportation driven rollers 48 of the transportation driven roller support member 70C mounted on the swing shaft mounting section 78C against the transportation driving roller 46 by adjusting the biasing force F1 of the biasing member 72.

That is, it is possible to eliminate or reduce the deviation of the position of each transportation driven roller 48 abutting the transportation driving roller 46 in the Y axis direction by deflection of the frame 68 on the side of the −Y axis direction (downstream side in the transportation direction) when mounting the biasing member 72 by deviating in advance the mounting position of the transportation driven roller support members 70 across the center portion from both sides in FIG. 68 on the side of the +Y axis direction in FIG. 7 (see FIG. 9).

In this configuration, since the biasing force Fy including the +Y axis direction component is applied to the frame 68 in the −Y axis direction that is the transportation direction of the sheet P when mounting the biasing member 72, the frame 68 is deflected on the side of the −Y direction. As a result, since the position of the transportation driven rollers 48 of which the positions are disposed by being deviated on the side of the +Y direction is displaced on the side of the −Y direction, the deviation of the positions in the Y axis direction with respect to the transportation driven rollers 48 positioned on the both ends in the X axis direction is eliminated. As a result, since the deviation of the positions of the plurality of transportation driven rollers 48 in the Y axis direction in the transportation path is eliminated or reduced, it is possible to maintain the transportation accuracy and the recording quality of the sheet P.

Furthermore, for the plurality of transportation driven rollers 48, the transportation driven roller 48 positioned in the center portion in the X axis direction is deviated in the +Y direction with respect to the transportation driven rollers 48 positioned in ends in the X axis direction that is the direction intersecting the −Y axis direction that is the transportation direction of the sheet P in a state where the biasing member 72 is not mounted. According to the configuration, when mounting the biasing member 72, since the biasing force Fy including the −Y direction component that is the transportation direction of the sheet P is applied to the frame 68, the frame 68 is deflected on the side of the −Y direction and the positions of the transportation driven rollers 48 of which the positions are disposed by being deviated on the side of the +Y direction are displaced on the side of the −Y direction. As a result, the deviation of the position in the −Y direction with respect to the transportation driven rollers 48 positioned in both ends in the X axis direction is eliminated or reduced. Therefore, since the deviation of the positions of the plurality of transportation driven rollers 48 in the transporting direction in the transportation path of the sheet P is eliminated or reduced, it is possible to maintain the transportation accuracy and the recording quality of the sheet P.

Furthermore, the deviation amount of the plurality of transportation driven rollers 48 from the ends in the X axis direction to the center in the +Y direction increases. Furthermore, when the frame 68 extending along the X axis direction is deflected, the deflection amount from the both ends of the frame 68 to the center is gradually increased. Therefore, the deflection amount of the frame 68 cancels the deviation amount of the positions of the transportation driven rollers 48 and the deviation of the positions in the Y axis direction between the transportation driven rollers 48 positioned in both ends in the X axis direction and the transportation driven roller 48 disposed therebetween is eliminated or reduced. As a result, it is possible to maintain the transportation accuracy and the recording quality of the sheet P.

Furthermore, for the position in which the transportation driven roller support member 70 is mounted on the frame 68, at least a part of the mounting positions of the transportation driven roller support members 70A and 70B disposed between the mounting positions of the transportation driven roller support members 70C positioned in both ends in the X axis direction intersecting the Y axis direction is disposed by being deviated in the +Y axis direction with respect to the mounting positions of the transportation driven roller support members 70C. Therefore, since the transportation driven roller support members 70 can be formed in a uniform shape, it is possible to be used as a common member and to reduce the cost.

Modification Example of First Embodiment (1) In the embodiment, the positions of the swing shaft mounting sections 78A, 78B, and 78C in the Y axis direction are in the same positions as each other and the mounting positions of the transportation driven rollers 48 may be deviated in the transportation driven roller support members 70A, 70B, and 70C instead of the configuration in which the positions of the swing shaft mounting sections 78A, 78B, and 78C of the frame 68 are deviated along the Y axis direction.

Specifically, the mounting positions of the transportation driven rollers 48 of the transportation driven roller support member 70B are deviated by the distance L1 on the side of the +Y direction with respect to the mounting positions of the transportation driven rollers 48 of the transportation driven roller support member 70C. The mounting position of the transportation driven roller 48 of the transportation driven roller support member 70A is disposed by being deviated by the distance L2 on the side of the +Y direction.

According to the configuration, it is possible to easily deviate the positions of the transportation driven rollers 48 with respect to the frame 68. Therefore, since the positions of transportation driven rollers 48 are disposed by being deviated with respect to the frame 68 with a simple configuration, it is possible to suppress the increase in cost.

(2) In the embodiment, a plurality of frames 68 are provided in the apparatus body 12 and the transportation driven roller support members 70A, 70B, and 70C may be mounted and supported on the frames 68, respectively, instead of the configuration in which the frame 68 on which the transportation driven roller support members 70A, 70B, and 70C are mounted is formed as a single frame extending in X axis direction.

According to the configuration, since the frame 68 is separately provided for each transportation driven roller support member 70, it is possible to reduce the pressing force F3 received by each frame 68 from the biasing member 72. As a result, since the deflection generated in the frame 68 can be reduced, it is possible to reduce the deviation amount of the positions of the transportation driven rollers 48 in the Y axis direction. Furthermore, since the pressing force F3 received by the frame 68 is reduced, the rigidity of the frame 68 does not need to be larger than necessary. Therefore, it is possible to thin each frame 68 and to reduce the cost while suppressing an increase in size of the printer 10.

(3) In the embodiment, the abutting positions of the transportation driven rollers 48 disposed in the both ends against the transportation driving roller 46 may be deviated with respect to the position of the transportation driven roller 48 disposed in the center portion abutting the transportation driving roller 46 on the side of the −Y direction instead of the configuration in which the position of the transportation driven roller 48 disposed in the center portion abutting the transportation driving roller 46 in the X axis direction is deviated with respect to positions of the transportation driven rollers 48 disposed in both ends abutting the transportation driving roller 46 on the side of the +Y direction.

Furthermore, in the embodiment, the frame 68 and the transportation driven roller support members 70 according to the invention are applied to the ink jet printer as an example of the recording apparatus, but it is possible to generally apply to other liquid ejecting apparatuses.

Here, for the liquid ejecting apparatus, an ink jet type recording head is used and the invention is not limited to the recording apparatus such as a printer, a copying machine, a facsimile, and the like in which the recording is performed on the recording medium by ejecting ink from the recording head. The invention includes an apparatus in which a liquid other than ink is ejected from a liquid ejecting head corresponding to the ink jet type recording head on an ejecting medium corresponding to the recording medium, and the liquid is adhered to the ejecting medium.

As the liquid ejecting head, in addition to the recording head, a coloring material ejecting head used for manufacturing color filters for liquid crystal display and the like, an electrode material (conductive paste) ejecting head used for forming an electrode for organic EL display, surface emission display (FED) or the like, a bio-organic material ejecting head used for manufacturing biochips, a sample ejecting head as a precision pipette, and the like are included.

Moreover, the invention is not limited to the embodiments described above and various modifications are possible within the scope of the invention described in the claims. Of course, those are also included within the scope of the invention.

The entire disclosure of Japanese Patent Application No. 2013-161084, filed Aug. 2, 2013 is expressly incorporated by reference herein

What is claimed is:

1. A recording apparatus comprising:

a recording section that performs recording on a recording medium;

a transportation driving roller that is disposed in a transportation path of the recording medium;

a plurality of transportation driven rollers that are driven to rotate by abutting against the transportation driving roller and are disposed along a direction intersecting a transportation direction of the recording medium, and are biased to the transportation driving roller and contact the transportation driving roller; and a frame that defines positions of the transportation driven rollers in the transportation direction and extends along the direction intersecting the transportation direction, wherein a biasing member, when mounted, biases the transportation driven rollers and applies a biasing force including a first direction component that is in the transportation direction of the recording medium to the frame in a state of being mounted thereon, and wherein at least a part of the transportation driven rollers that is disposed between the transportation driven rollers that are positioned in both ends in the direction intersecting the transportation direction is disposed by being deviated in the position thereof in a second direction that is opposite to the first direction with respect to the transportation driven rollers that are positioned in both ends in the direction intersecting the transportation direction in a state where the biasing member is not mounted thereon.

2. The recording apparatus according to claim 1, wherein the transportation driven roller that is positioned in a center portion in the direction intersecting the transportation direction is deviated in the second direction with respect to the transportation driven rollers positioned in the both ends in the direction intersecting the transportation direction in the state where the biasing member is not mounted thereon.

3. The recording apparatus according to claim 1, wherein the plurality of transportation driven rollers have a deviation amount that increases in the second direction from the both ends in the direction intersecting the transportation direction to the center.

4. The recording apparatus according to claim 2, wherein the plurality of transportation driven rollers have a deviation amount that increases in the second direction from the both ends in the direction intersecting the transportation direction to the center.

5. The recording apparatus according to claim 1, wherein a plurality of support members supporting the transportation driven rollers are held in the frame along the direction intersecting the transportation direction, and wherein at least a part of the support members that is disposed between the support members that are positioned in both ends in the direction intersecting the transportation direction is disposed by being deviated in the position thereof in the second direction with respect to the support members that are positioned in both ends in the direction intersecting the transportation direction in a state where the biasing member is not mounted thereon.

6. The recording apparatus according to claim 2, wherein a plurality of support members supporting the transportation driven rollers are held in the frame along the direction intersecting the transportation direction, and wherein at least a part of the support members that is disposed between the support members that are positioned in both ends in the direction intersecting the transportation direction is disposed by being deviated in the position thereof in the second direction with respect to the support members that are positioned in both ends in the direction intersecting the transportation direction in a state where the biasing member is not mounted thereon.

7. The recording apparatus according to claim 3, wherein a plurality of support members supporting the transportation driven rollers are held in the frame along the direction intersecting the transportation direction, and wherein at least a part of the support members that is disposed between the support members that are positioned in both ends in the direction intersecting the transportation direction is disposed by being deviated in the position thereof in the second direction with respect to the support members that are positioned in both ends in the direction intersecting the transportation direction in a state where the biasing member is not mounted thereon.

8. The recording apparatus according to claim 5, wherein the plurality of support members are swingably provided with respect to a plurality of bearings formed in the frame, and wherein at least a part of the bearings that is disposed between the bearings that are positioned in both ends in the direction intersecting the transportation direction is formed by being deviated in the position thereof in the second direction with respect to the bearings that are positioned in both ends in the direction intersecting the transportation direction in a state where the biasing member is not mounted thereon.

9. The recording apparatus according to claim 6, wherein the plurality of support members are swingably provided with respect to a plurality of bearings formed in the frame, and wherein at least a part of the bearings that is disposed between the bearings that are positioned in both ends in the direction intersecting the transportation direction is formed by being deviated in the position thereof in the second direction with respect to the bearings that are positioned in both ends in the direction intersecting the transportation direction in a state where the biasing member is not mounted thereon.

10. The recording apparatus according to claim 7, wherein the plurality of support members are swingably provided with respect to a plurality of bearings formed in the frame, and wherein at least a part of the bearings that is disposed between the bearings that are positioned in both ends in the direction intersecting the transportation direction is formed by being deviated in the position thereof in the second direction with respect to the bearings that are positioned in both ends in the direction intersecting the transportation direction in a state where the biasing member is not mounted thereon.

11. The recording apparatus according to claim 5, wherein a plurality of frames are provided.

12. The recording apparatus according to claim 8, wherein a plurality of frames are provided.

* * * * *